US007545248B2

(12) United States Patent
Imanishi et al.

(10) Patent No.: US 7,545,248 B2
(45) Date of Patent: Jun. 9, 2009

(54) STRUCTURE OF MAGNET SWITCH ENSURING STABILITY OF INSTALLATION OF SEAL

(75) Inventors: Tomoya Imanishi, Kariya (JP); Youichi Hasegawa, Kasugai (JP)

(73) Assignee: Denso Corporation, Kariya (JP)

( * ) Notice: Subject to any disclaimer, the term of this patent is extended or adjusted under 35 U.S.C. 154(b) by 96 days.

(21) Appl. No.: 11/902,884

(22) Filed: Sep. 26, 2007

(65) Prior Publication Data

US 2008/0143463 A1 Jun. 19, 2008

(30) Foreign Application Priority Data

Oct. 4, 2006 (JP) ..... 2006-273193

(51) Int. Cl.
*H01H 13/04* (2006.01)
*H01H 67/02* (2006.01)

(52) U.S. Cl. ..... 335/202; 335/131; 335/278; 335/282

(58) Field of Classification Search ..... 335/131, 335/132, 202, 278, 282; 336/107, 192
See application file for complete search history.

(56) References Cited

U.S. PATENT DOCUMENTS 5,157,367 A * 10/1992 Itoh et al. ..... 335/126
5,812,041 A * 9/1998 Ishikawa et al. ..... 335/126
6,404,310 B1 * 6/2002 Ando et al. ..... 335/133
6,762,663 B2 7/2004 Andoh et al.
7,038,563 B2 5/2006 Andoh et al.

FOREIGN PATENT DOCUMENTS

JP 2000048899 A * 2/2000
JP A 2002-313205 10/2002

* cited by examiner

*Primary Examiner*—Ramon M Barrera
(74) *Attorney, Agent, or Firm*—Oliff & Berridge, PLC

(57) ABSTRACT

A magnet switch which may be employed in automotive engine starters is provided. The magnet switch includes a metallic terminal which extends through a hole formed in a switch cover to have one of ends thereof protruding outside the cover. The other end of the terminal is connected to an exciting coil to energize it to establish an electric connection between contacts. The magnet switch also includes a cylindrical seal and a stopper. The seal is fit on the end of the terminal to hermetically seal a clearance between the hole and the terminal. The stopper provided on the terminal works to stop the seal from moving to the other end of the terminal, thereby ensuring the stability of installation and sealing performance of the seal in the magnet switch.

6 Claims, 5 Drawing Sheets

STRUCTURE OF MAGNET SWITCH ENSURING STABILITY OF INSTALLATION OF SEAL

CROSS REFERENCE TO RELATED DOCUMENT

The present application claims the benefit of Japanese Patent Application No. 2006-273193 filed on Oct. 4, 2006, the disclosure of which is incorporated herein by reference.

BACKGROUND OF THE INVENTION

1. Technical Field of the Invention

The present invention relates generally to a magnet switch which may be employed in a starter working to start an internal combustion engine of automotive vehicles, and more particularly to an improved structure of such a magnet switch designed to ensure the stability of installation of a seal without increasing production costs.

2. Background Art

Japanese Patent First Publication No. 2002-313205 teaches a solenoid switch working as a magnet switch for use in a starter to start internal combustion engines. The solenoid switch is equipped with terminals, a molded cover, and sealing members. The terminals are press-fit in holes in terminal mounts formed on a flange of a bobbin. Each of the terminal mount has formed thereon upright walls which serve to hold a corresponding one of the terminals from moving in a thickness-wise direction of the terminal. Each of the terminals has a ring-shaped seal fitted thereon. The molded cover has formed therein holes through which the terminals pass to have ends extending outside the molded cover. Each of the sealing members is pressed within a recess formed in an inner wall of the molded cover to establish hermetical sealing between the terminal and the hole of the molded cover, thereby ensuring the hermeticity inside the molded cover.

When the molded cover is installed on the solenoid switch, it may push the sealing members toward the flange undesirably. The upright walls serve to minimize such movement of the sealing members. The upright walls are formed integrally with the bobbin made of resin and. Accordingly, when it is required to locate the upright walls near the end of the terminals, the need arises to increase the length of the upright wall as long as possible. This, however, results in an increase in production cost of the bobbin, which leads to an increased total cost of the solenoid switch.

SUMMARY OF THE INVENTION

It is therefore a principal object of the invention to avoid the disadvantages of the prior art.

It is another object of the invention to provide an improved structure of a magnet switch designed to ensure the stability of installation of a seal without increasing production costs thereof.

According to one aspect of the invention, there is provided a magnet switch which may be installed in a starter for internal combustion engines. The magnet switch comprises: (a) an exciting coil; (b) contacts; (c) a cover having a hole formed therein, the cover being disposed to cover the contacts; (d) a metallic terminal having a length made up of a first and a second end portion, the terminal extending through the hole of the cover to have the first end portion protruding outside the cover, the second end portion being connected to the exciting coil to energize the exciting coil to establish an electric connection between the contacts; (e) a cylindrical seal fitted on the first end portion of the terminal to hermetically seal a clearance between the hole and the terminal; and (f) a stopper provided on the terminal to stop the seal from moving to the second end portion of the terminal.

Specifically, the stopper serves to minimize an undesirable positional shift of the seal, especially when the cover is joined to the magnet switch, thus ensuring the stability of installation and sealing performance of the seal in the magnet switch without the need for formation of upright walls serving as a stopper, like in the conventional structure discussed in the introductory part of this application.

In the preferred mode of the invention, the terminal includes a strip body which has a portion extending in a widthwise direction of the strip body to define the stopper.

The strip body may alternatively have a portion which extends outward in the widthwise direction of the strip body and is then bent inward in the widthwise direction to define the stopper.

The strip body may alternatively have a portion which is cut and bent in a thickness-wise direction of the strip body to define the stopper.

The terminal may also include additional stoppers. The stopper and the additional stoppers may be designed to lie at sides of surfaces opposed in the widthwise direction of the strip body and also at sides of surfaces opposed in the thickness-wise direction of the strip body.

The stopper may lie on the second end portion of the terminal to hold the seal on a side of the second end portion remote from the center of the terminal in a lengthwise direction thereof. This results in an increased interval between two points at which the terminal is retained, which leads to the minimized mechanical vibrations of the terminal.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings:

FIG. 2(*b*) is a front view which illustrates the terminal of FIG. 2(*a*);

FIG. 2(*c*) is a side view which illustrates the terminal of FIG. 2(*a*);

FIG. 3(*b*) is a front view of FIG. 3(*a*);

FIG. 3(*c*) is a transverse sectional view of FIG. 3(*b*);

FIG. 4(*b*) is a front view which illustrates the terminal of FIG. 4(*a*);

FIG. 4(*c*) is a side view which illustrates the terminal of FIG. 4(*a*);

FIG. 5(*b*) is a front view which illustrates the terminal of FIG. 5(*a*); and FIG. 5(*c*) is a side view which illustrates the terminal of FIG. 5(*a*).

DESCRIPTION OF THE PREFERRED EMBODIMENTS

Figure 1:
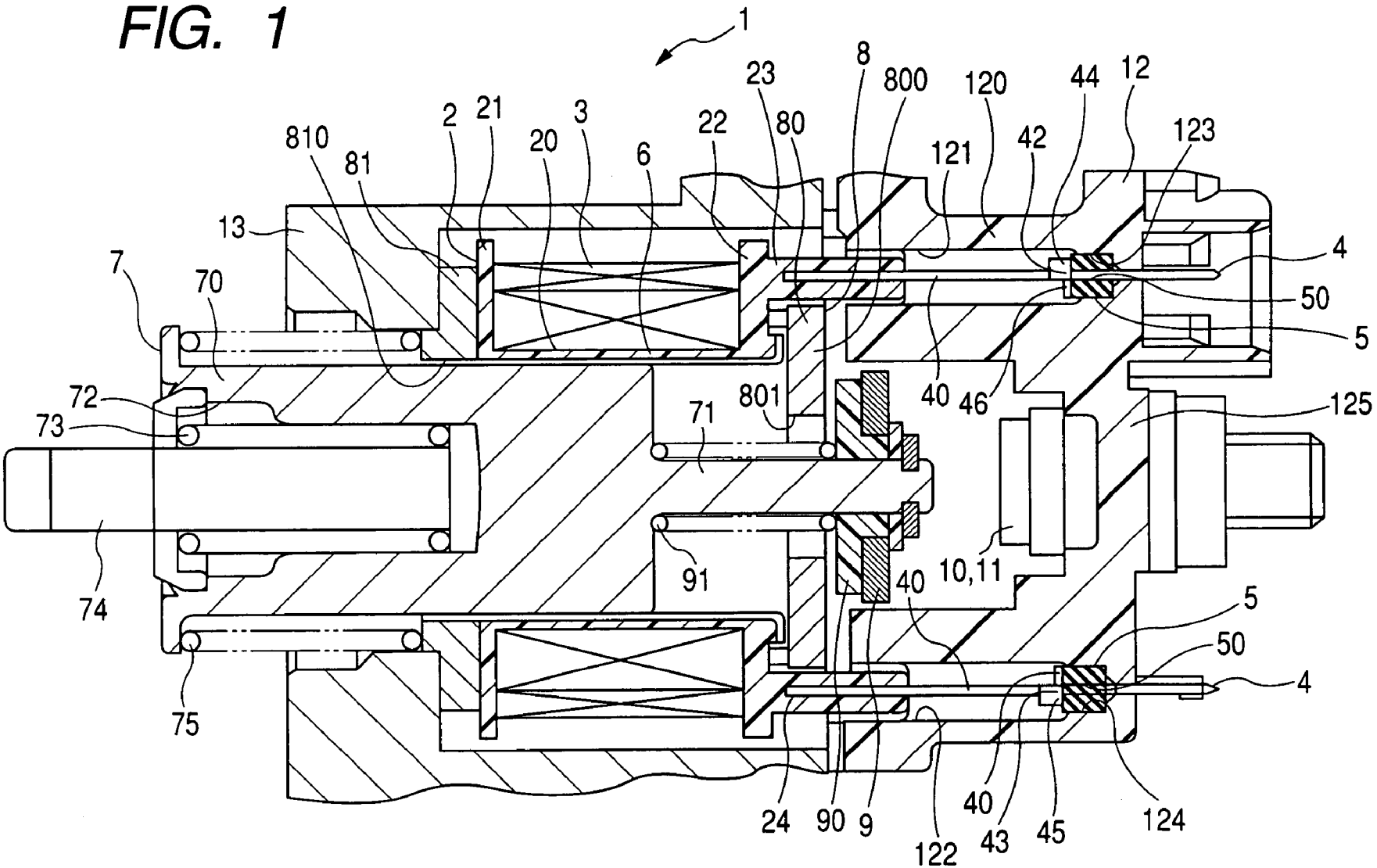
FIG. 1 is a longitudinal sectional view which shows a magnet switch for use in an engine starter according to the first embodiment of the invention.

Referring to the drawings, wherein like reference numbers refer to like parts in several views, particularly to FIG. 1, there is shown a magnet switch 1 for engine starters according to the first embodiment of the invention. The magnet switch 1 may be used in starting automotive internal combustion engines.

The magnet switch 1 consists essentially of a bobbin 2, an exciting coil 3, terminals 4, seals 5, a sleeve 6, a plunger 7, a core 8, a movable contact 9, stationary or fixed contacts 10 and 11, and a contact cover 12.

The bobbin 2 is of a cylindrical shape and made of resin for electrical insulation from other parts and retains therein the exciting coil 3. The bobbin 2 is made up of a cylinder 20 and flanges 21 and 22 extending radially from ends of the cylinder 20. The flange 22 has terminal mount extensions 23 and 24 for mounting the terminals 4 therein.

The exciting coil 3 works to produce magnetic attraction to attract the plunger 7 when energized. The exciting coil 3 is made of wire wound around the cylinder 20 of the bobbin 2.

Figure 2A:
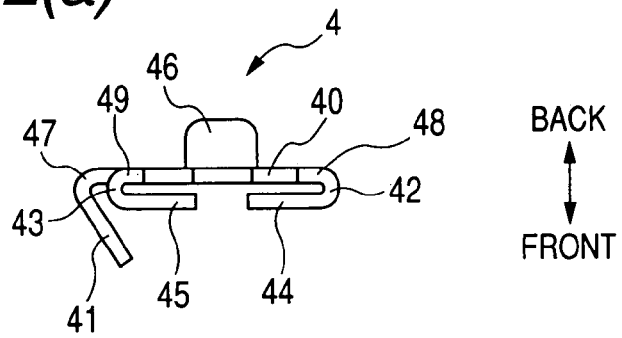
FIG. 2(*a*) is a top view which illustrates a terminal installed in the magnet switch of FIG. 1.
Figure 2B:
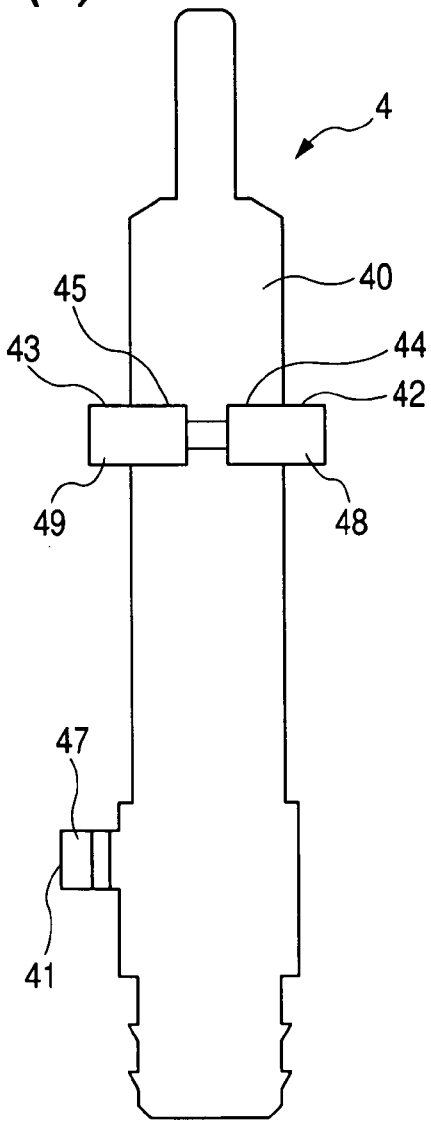
Figure 2C:
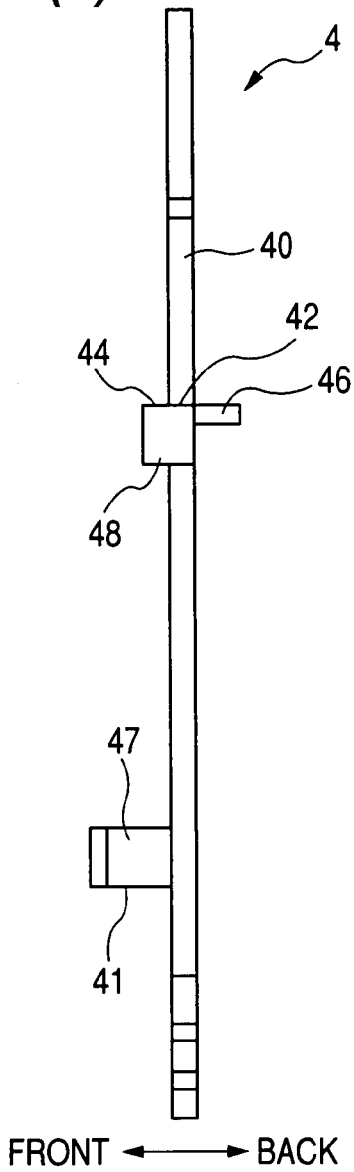

Each of the terminals 4 is made of a substantially rectangular metallic strip and used to supply electric power to the exciting coil 3. Each of the terminals 4 is, as clearly illustrated in FIGS. 2(*a*), 2(*b*), and 2(*c*), made up of a strip body 40, and stoppers 41, 42, 43, 44, 45, and 46.

The connector 41 is designed to make an electrical connection of a corresponding one of ends of the exciting coil 3 to the body 40. The connector 41 is formed on one of end portions of the body 40 and made by a strip 47, as clearly illustrated in FIG. 2(*a*), bent in a width-wise direction of the body 40 on a front side thereof (i.e., a downward side, as viewed in FIG. 2(*a*)) to have a substantially C-shape.

The stoppers 42 to 46 serve to stop the seals 5 from moving toward the end of the body 40 (i.e., the leftward, as viewed in FIG. 1) when the contact cover 12 is joined to a casing 13. The stoppers 42 to 46 also serve as a holder to hold the seal 5 within the contact cover 12. The stoppers 42 to 46 are formed on the other of the end portions of the body 40 away from the connector 41 across the center of the body 40, as viewed longitudinally. The stoppers 42 and 42 extend from side surfaces of the body 40. The stoppers 44 and 45 are retained over the front surface of the body 40. Specifically, strips 48 and 49 are formed on the body 40 to extend from the side surfaces thereof to define the stoppers 42 and 43 and be bent inwardly in opposite directions (i.e., width-wise directions of the body 40) to define the stoppers 44 and 45 over the front surface of the body 40. The stopper 46 is formed by cutting a central portion of the body 40 partially in the width-wise direction and bending it at right angles to the back surface of the body 40.

Figure 3A:
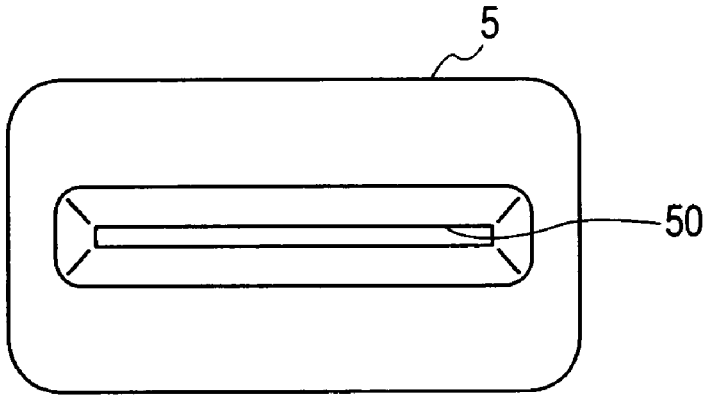
FIG. 3(*a*) is a top view which illustrates a seal to be installed on the terminal of FIGS. 2(*a*) to 2(*c*)
Figure 3B:
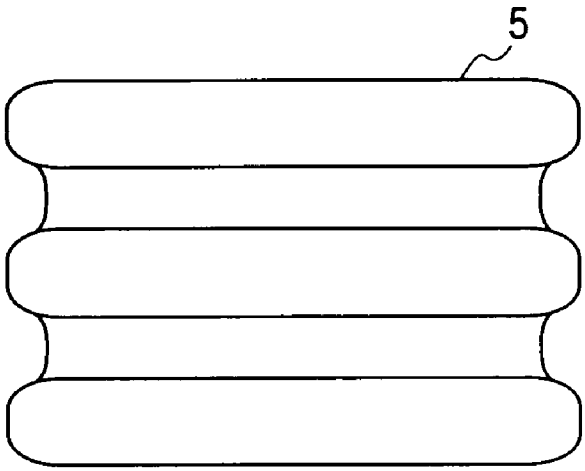
Figure 3C:
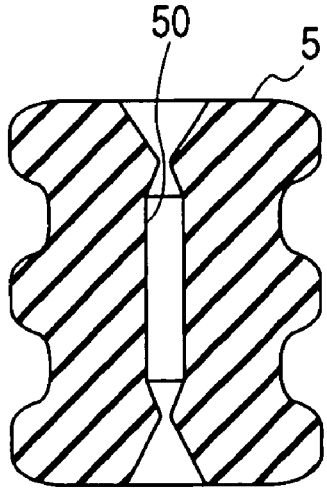

Referring back to FIG. 1, each of the seals 5 is made of a cubic elastic block and fitted on one of the terminals 4 to hermetically seal a clearance between the terminal 4 and the contact cover 12. Each of the seals 5, as clearly illustrated in FIGS. 3(*a*) to 3(*c*), has formed in a slit 50 (i.e., a rectangular through hole) contoured to conform with the shape of a lateral section of the body 40 of the terminal 4.

The bodies 40 of the terminals 40 are press-fit at ends thereof in the mount extensions 23 and 24 of the bobbin 2. The ends of the exciting coil 3 are held by and joined to the connectors 41 of the terminals 4. Each of the seals 5 is hermetically fit at the inner periphery of the slit 50 with the outer periphery of the body 40 of the terminal 4 and disposed in abutment of the end thereof with the stoppers 42 to 46.

The sleeve 6 retains the plunger 7 to be reciprocable therein and is formed by a hollow cylindrical member made of a non-magnetic material for minimizing the physical wear of the bobbin 2 due to sliding motion of the plunger 7. The sleeve 6 is disposed inside the cylinder 20 of the bobbin 2.

The plunger 7 forms a part of a magnetic circuit and is subjected to magnetic attraction, as produced by the exciting coil 3, so that it moves a lever (not shown) equipped with a pinion (not shown) to establish engagement with, for example, a ring gear of the engine to crank the engine and also to move the movable contact 9. The plunger 7 is formed by a hollow cylinder made of a magnetic material and includes a large-diameter portion 70 and a small-diameter portion 71 extending from a rear end of the large-diameter portion 70 in alignment with an axis of the magnet switch 1. The large-diameter portion 70 has a cylindrical chamber 72 opening at a front end thereof. A rod 74 is disposed within the chamber 72 and biased rearward by a drive spring 73. The rod 74 works to move the lever equipped with the pinion. The plunger 7 is disposed within the sleeve 6 in slidable contact of the outer periphery of the large-diameter portion 70 with the inner periphery of the sleeve 6. The plunger 7 is also urged frontward by a return spring 75 between a front flange thereof and a plate 81, as will be described later in detail.

The core 8 serves to form the part of the magnetic circuit and is made of magnetic material to produce the magnetic attraction acting on the plunger 7 through the exciting coil 3. The core 8 is made up of a frame 80 and the plate 81.

The frame 80 includes a plate bottom 800 and plate-like side walls (not shown) extending from ends of the bottom 800 in the same direction. The bottom 800 has formed in the center thereof a hole 801 through which the small-diameter portion 71 of the plunger 7 extends. The frame 80 is disposed to surround the outer periphery of the bobbin 2 around which the exciting coil 3 is wound in abutment of the bottom 800 with the rear end of the bobbin 2.

The plate 81 has formed in the center thereof a hole or opening 810 in which the sleeve 6 is disposed and through which the large-diameter portion 70 of the plunger 7 extends. The plate 81 is disposed in abutment of ends thereof with the side walls of the frame 80.

The bobbin 2, the exciting coil 3, the sleeve 6, the plunger 7, and the core 8 are disposed inside the hollow cylindrical casing 13 with a bottom which is made of a non-magnetic material.

The movable contact 9 is made of a metallic plate and to be moved by the plunger 7 to establish or break electrical connection between the fixed contacts 10 and 11. The movable contact 9 is secured to the rear end of the small-diameter portion 71 of the plunger 7 through an insulator 90 and also urged by a contact spring 91 toward the fixed contacts 10 and 11 along with the insulator 90.

The fixed contacts 10 and 11 are each made of a metallic bolt. When the fixed contacts 10 and 11 are connected electrically through the movable contact 9, it will cause the electric power to be supplied from a battery (not shown) to an electric motor (not shown) of the starter. The fixed contacts 10 and 11 are located at a given interval away from each other.

The contact cover 12 is made of a resinous hollow cylindrical member with a bottom 125 and disposed to cover the movable contact 9 and retains the fixed contacts 10 and 11 and the terminals 4 firmly. The contact cover 12 has a side wall 120 in which holes 121 and 122 are formed through which the terminals 4 pass. The contact cover 12 has also formed at ends of the holes 121 and 122 cavities 123 and 124 in which the seals 5 are press-fit. The fixed contacts 10 and 11 are secured on an inner wall of the bottom 125 at a given interval away from each other. Specifically, the contact cover 12 is disposed on the rear end of the casing 13 to have the fixed contacts 10 and 11 facing the movable contact 9 and covers the movable contact 9. The terminals 4 are inserted through the holes 121 and 122 to have ends of the bodies 40 of the terminals 4 protruding outside the bottom 125 of the contact cover 12. The seals 5 are press-fit within the cavities 123 and 124 of the holes 121 and 122 to hermetically seal the terminals 4, respectively. The installation of the contact cover 12 onto the casing 13 is achieved by inserting the terminals 4 with the seals 5 into the holes 121 and 122 and moving the contact cover 12 frontward (i.e., the leftward, as viewed in FIG. 1). This causes the seals 5 to be urged frontward upon insertion into the cavities 123 and 124. The stoppers 42 to 46 of the terminals 4, however, serve to hold the seals 5 from moving, thus ensuring the hermetic insertion of the seals 5 into the cavities 123 and 124 in place. This assures the sealing of clearances between the holes 121 and 122 and the terminals 4. Theses beneficial effects may be achieved by designing the terminals 4 to have at least one of the stoppers 42 to 46.

The operation of the magnet switch 1 will be described below with reference to FIG. 1.

When an ignition switch (not shown) of the vehicle is turned on, the exciting coil 3 is energized through the terminals 4 to produce the magnetic attraction to attract the plunger 7 toward the frame 80 of the core 8 against the elastic pressure, as produced by the return spring 75. This causes the rod 74 to move the pinion-installed lever to establish the engagement of the pinion with the ring gear of the engine and also to move the movable contact 9 into abutment with the fixed contacts 10 and 11, thereby supplying the electric power to the motor of the starter to crank the engine.

When the engine has started, and the ignition switch has been turned off, it will cause the exciting coil 3 to be deenergized, so that the magnetic attraction disappears. The plunger 7 is then moved by the return spring 75 frontward together with the rod 74, so that the pinion is disengaged from the ring gear of the engine. The movable contact 9 is also moved away from the fixed contacts 10 and 11, thereby cutting the supply of power to the motor of the starter.

The beneficial effects, as produced by the improved structure of the magnet switch 1, will be described below.

The magnet switch 1 is designed to minimize a positional shift of the seals 5 upon installation of the contact cover 12 onto the casing 13 without the need for additional costs. Specifically, the seals 5 are held by the stoppers 42 to 46 of the terminals 4 from moving frontward (i.e., the leftward, as viewed in FIG. 1) during the installation of the contact cover 12. This eliminates the need for formation of upright walls serving as stoppers on the bobbin 2, like in the conventional structure discussed in the introductory part of this application. The terminals 4 are made of metal and thus permitted to form the stoppers 42 to 46 at decreased costs as compared with the bobbin 2.

The stoppers 42 to 46 lie at sides of the side walls, the front wall, and the back wall, thus ensuring the stability in retaining the seals 5.

The body 40 of each of the terminals 4 retains the seal 5 at the end portion thereof, thereby minimizing mechanical vibrations of the terminal 4. Specifically, the terminal 4 is of a substantially rectangular shape and susceptible to vibrations. The body 40 is press-fit at one of the end portions thereof in one of the mount extensions 23 and 24 of the bobbin 2. The end of the exciting coil 3 is joined to the connector 41 of the terminal 41. In contrast, the other end portion of the body 40 is retained by the contact cover 12 through the seal 5, thereby resulting in an increased interval between two points at which the terminal 4 is retained, which leads to the minimized mechanical vibrations of the terminal 4.

Figure 4A:
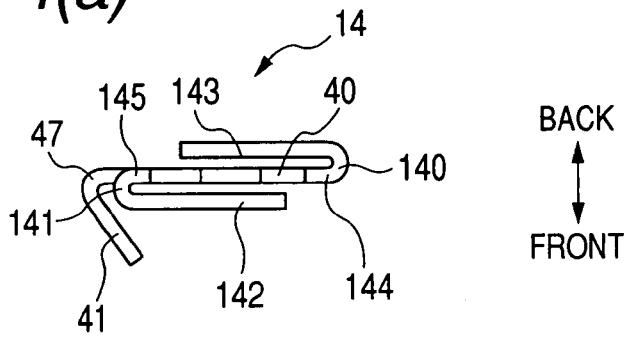
FIG. 4(*a*) is a top view which illustrates a terminal installed in the magnet switch of FIG. 1 according to the second embodiment of the invention.
Figure 4B:
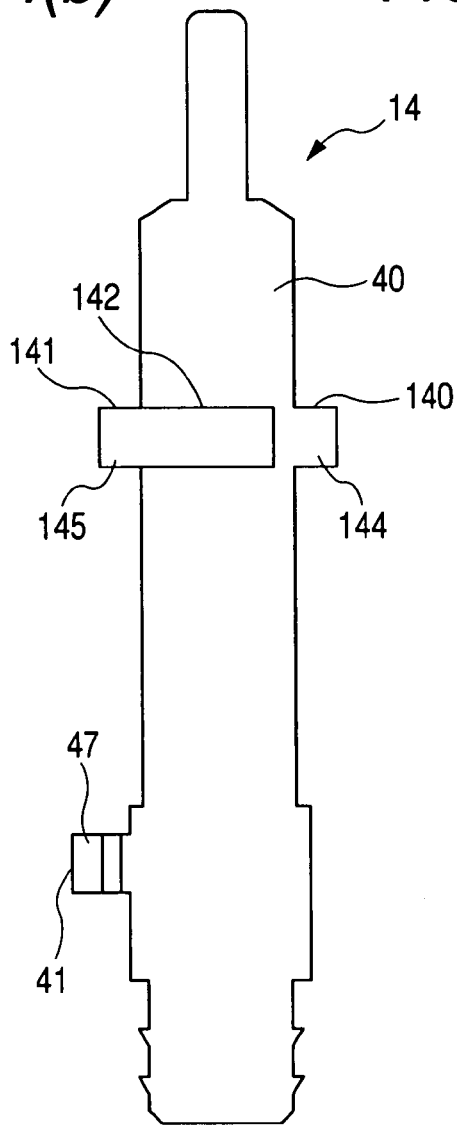
Figure 4C:
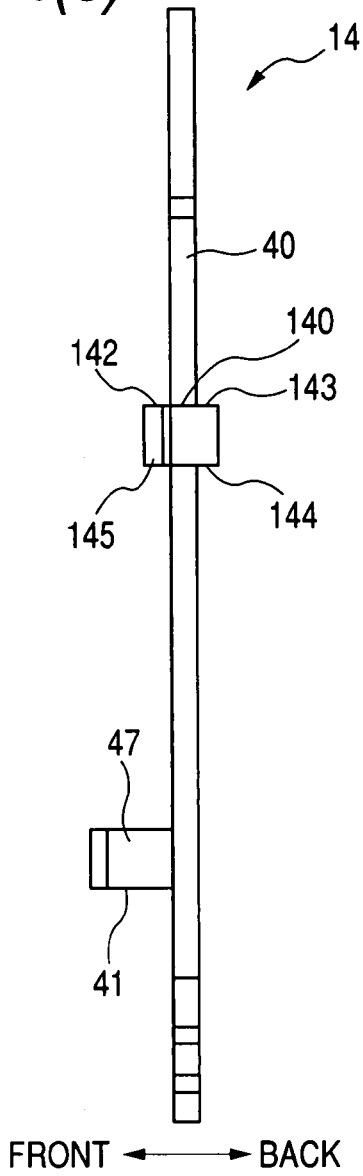

FIGS. 4(*a*) to 4(*c*) illustrate terminals 14 built in the magnet switch 1 according to the second embodiment of the invention. The same reference numbers, as employed in the first embodiment, will refer to the same parts, and explanation thereof in detail will be omitted here.

Each of the terminals 14 is made up of the strip body 40, the connector 41, and stoppers 140 to 143.

The connector 41 is formed on one of end portions of the body 40.

The stoppers 140 to 143 are formed on the other of the end portions of the body 40 away from the connector 41 across the center of the body 40, as viewed longitudinally in FIGS. 4(*b*) and 4(*c*). The stoppers 140 and 141 extend from the side surfaces of the body 40. The stoppers 142 and 143 continue from the stoppers 141 and 140 so that they are retained over the front and back surfaces of the body 40. Specifically, strips 144 and 145 are formed on the body 40 to extend from the side surfaces thereof to define the stoppers 140 and 141 and be bent inwardly in opposite directions (i.e., width-wise directions of the body 40) to define the stoppers 143 and 142 over the front and back surfaces of the body 40.

Figure 5A:
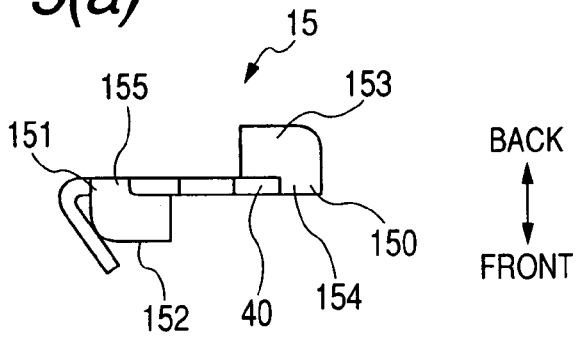
FIG. 5(*a*) is a top view which illustrates a terminal installed in the magnet switch of FIG. 1 according to the third embodiment of the invention.
Figure 5B:
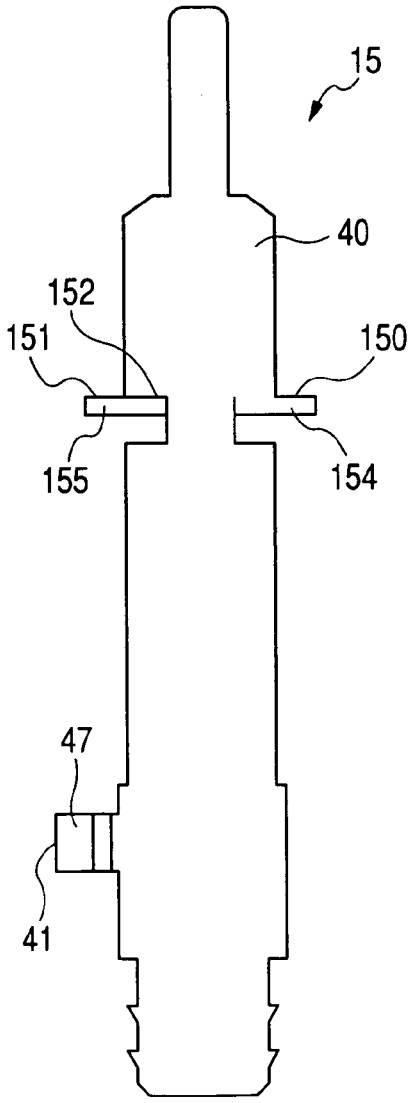
Figure 5C:
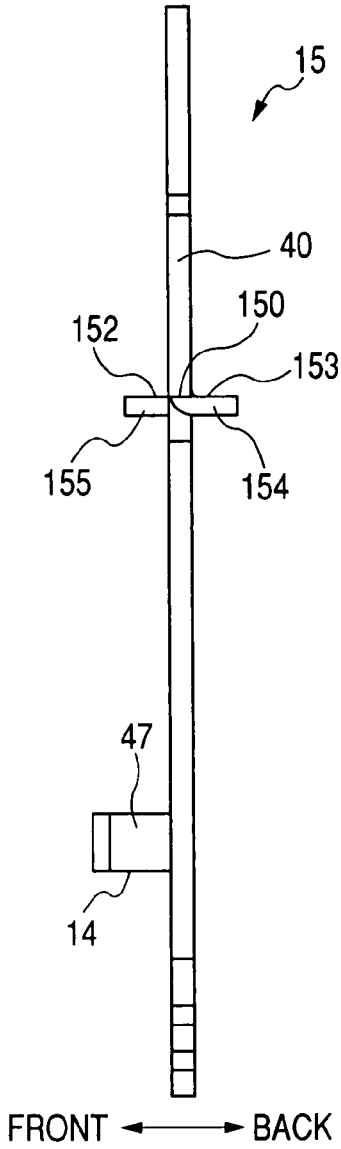

FIGS. 5(*a*) to 5(*c*) illustrate terminals 15 built in the magnet switch 1 according to the third embodiment of the invention. The same reference numbers, as employed in the first embodiment, will refer to the same parts, and explanation thereof in detail will be omitted here.

Each of the terminals 15 is made up of the body 40, the connector 41, and stoppers 150 to 153.

The connector 41 is formed on one of end portions of the body 40.

The stoppers 150 to 153 are formed on the other of the end portions of the body 40 away from the connector 41 across the center of the body 40, as viewed longitudinally in FIGS. 5(*b*) and 5(*c*). The stoppers 150 and 151 extend from the side surfaces of the body 40. The stoppers 152 and 153 continue from the stoppers 151 and 150 and extend partially forward and backward of the front and back surfaces of the body 40. Specifically, the stoppers 150 and 153 are formed by cutting a portion of the body 40 and bending a plate or tab 154 rearward at right angles to the back surface of the body 40. Similarly, the stoppers 151 and 152 are formed by cutting a portion of the body 40 and bending a tab 155 frontward at right angles to the front surface of the body 40.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments witch can be embodied without departing from the principle of the invention as set forth in the appended claims.

What is claimed is:

1. A magnet switch comprising:

an exciting coil;

contacts;

a cover having a hole formed therein, said cover being disposed to cover said contacts;

a metallic terminal having a length made up of a first and a second end portion, said terminal extending through the hole of said cover to have the first end portion protruding outside said cover, the second end portion being connected to said exciting coil to energize said exciting coil to establish an electric connection between said contacts;

a cylindrical seal fitted on the first end portion of said terminal to hermetically seal a clearance between the hole and said terminal; and a stopper provided on said terminal to stop said seal from moving to the second end portion of said terminal.

2. A magnet switch as set forth in claim 1, wherein said terminal includes a strip body which has a portion extending in a widthwise direction of the strip body to define said stopper.

3. A magnet switch as set forth in claim 1, wherein said terminal includes a strip body having a portion which extends outward in a widthwise direction of the strip body and is then bent inward in the widthwise direction to define said stopper.

4. A magnet switch as set forth in claim 1, wherein said terminal includes a strip body having a portion which is cut and bent in a thickness-wise direction of the strip body to define said stopper.

5. A magnet switch as set forth in claim 1, wherein said terminal includes a strip body, and further comprising additional stoppers, said stopper and said additional stoppers lying at sides of surfaces opposed in a widthwise direction of the strip body and also at sides of surfaces opposed in a thickness-wise direction of the strip body.

6. A magnet switch as set forth in claim 1, wherein said stopper lies on the first end portion of said terminal to hold said seal on a side of the first end portion remote from a center of said terminal in a lengthwise direction thereof.

* * * * *